US005131550A

United States Patent [19]

Thompson

[11] Patent Number: 5,131,550

[45] Date of Patent: Jul. 21, 1992

[54] CLOSURES FOR CONTAINERS

[76] Inventor: Nigel Thompson, 45 Lea Vale Road, Norton, Stourbridge, West Midlands, United Kingdom

[21] Appl. No.: 552,773

[22] Filed: Jul. 13, 1990

[30] Foreign Application Priority Data

Jul. 13, 1989 [GB] United Kingdom ..... 8916099

[51] Int. Cl.[5] ..... B65D 41/34

[52] U.S. Cl. ..... 215/252

[58] Field of Search ..... 215/252, 230, 258

[56] References Cited

U.S. PATENT DOCUMENTS

| | | | |
|---|---|---|---|
| 4,432,461 | 2/1984 | Mumford et al. | 215/252 |
| 4,461,390 | 7/1984 | Csaszar | 215/252 |
| 4,526,282 | 7/1985 | Dutt et al. | 215/252 |
| 4,549,667 | 10/1985 | Dullabaun | 215/252 |
| 4,560,076 | 12/1985 | Bolk | 215/252 |
| 4,749,095 | 6/1988 | Rote | 215/252 |
| 4,753,360 | 6/1988 | Baxter | 215/252 |
| 4,907,709 | 3/1990 | Abe et al. | 215/252 |
| 4,913,300 | 4/1990 | Wiedmer et al. | 215/252 |
| 4,915,244 | 4/1990 | Celaschi et al. | 215/252 |
| 4,936,474 | 6/1990 | Szczesniak et al. | 215/252 |

*Primary Examiner*—Stephen Marcus
*Assistant Examiner*—Vanessa Caretto

[57] ABSTRACT

A container closure moulded from plastics material has a top 10, an internally screw-threaded skirt 11, and a tamper-evident ring 13 connected to the bottom edge of the skirt by frangible bridges 15. The radially inner surface of the ring 13 is formed with an odd number of evenly spaced inwardly projecting protrusions 16 for engaging under a security band on the neck of a container. The use of an odd number of protrusions ensures that no two protrusions are diametrically opposite each other and in consequence permits the closure to shift or wriggle diametrally during application of the closure to a container and thus facilitates movement of the ring 13 past the security band. An annular groove 20 is formed on the radially-outer surface of the ring at a location axially between the upper ends of the protrusions 16 and the bridges 15, and serves to form an annular hinge about which the lower parts of the ring 13 can pivot during application of the closure.

5 Claims, 5 Drawing Sheets

CLOSURES FOR CONTAINERS

This invention relates to closures for containers and the manufacture thereof.

According to this invention there is provided a container closure molded from plastics material and comprising a top, an annular skirt depending from the top and formed with a screw-thread on its internal surface, and a tamper-evident ring connected to the end of the skirt remote from the top by a series of frangible bridges extending across an axial gap between the ring and the skirt or by a band of the material with a circumferential line of weakening therein, said ring having spaced along its inner surface a plurality of radially inwardly projecting protrusions each having an end abutment surface generally facing towards the top but having a slight inclination away from the top in a radially inward direction and an inwardly facing cam surface inclined away from the top, the protrusions being so disposed about the central axis of the closure that no two of the protrusions are diametrically opposite each other.

In preferred constructions according to the invention, the protrusions are uniformly disposed about the ring and are provided in an odd number.

In preferred arrangements according to the invention, the ring has an annular groove formed in one of its radially facing surfaces at a location axially between the protrusions and the bridges or the line of weakening. The groove may be formed on the radially inner surface of the ring but is preferably in the radially outer surface of the ring.

The invention will now be described in more detail with reference by way of example to the accompanying diagrammatic drawings in which.

Figure 1:
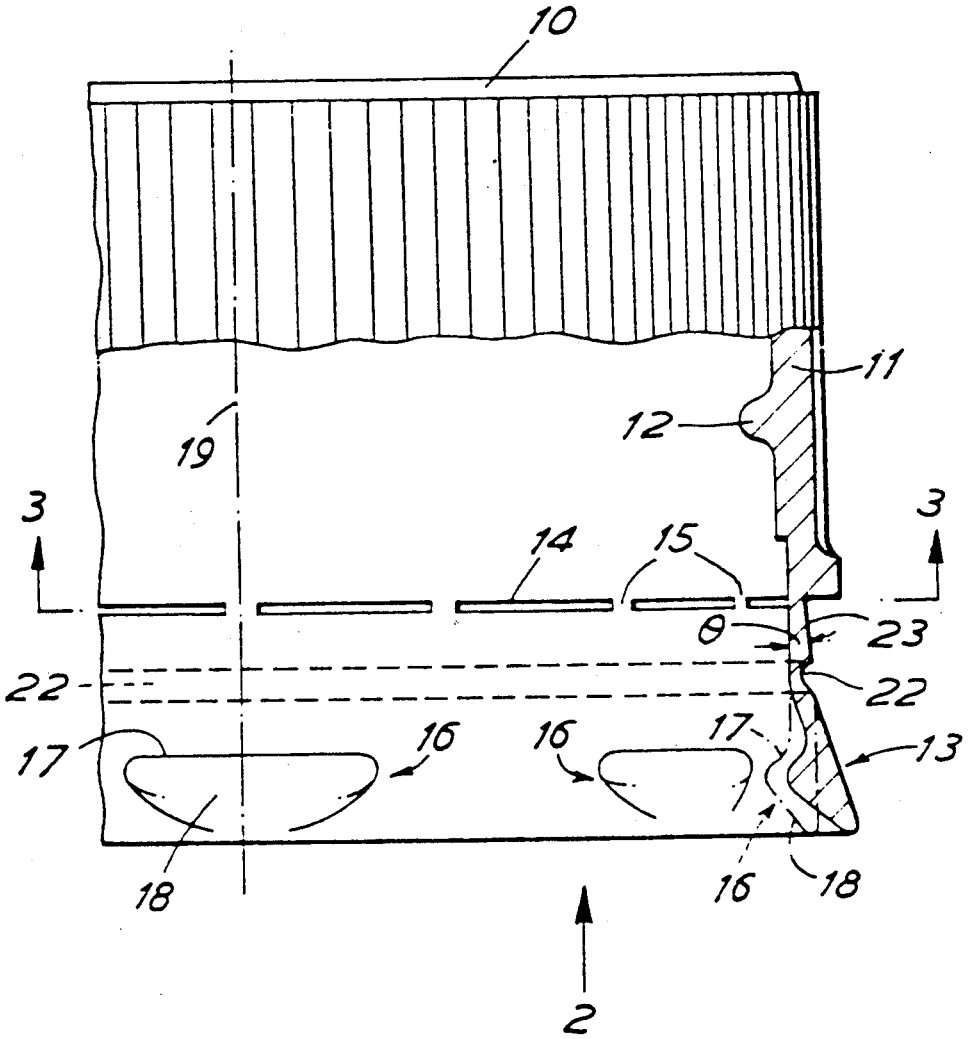
FIG. 1 is an elevation, partly in axial section, of a closure according to the invention.
Figure 2:
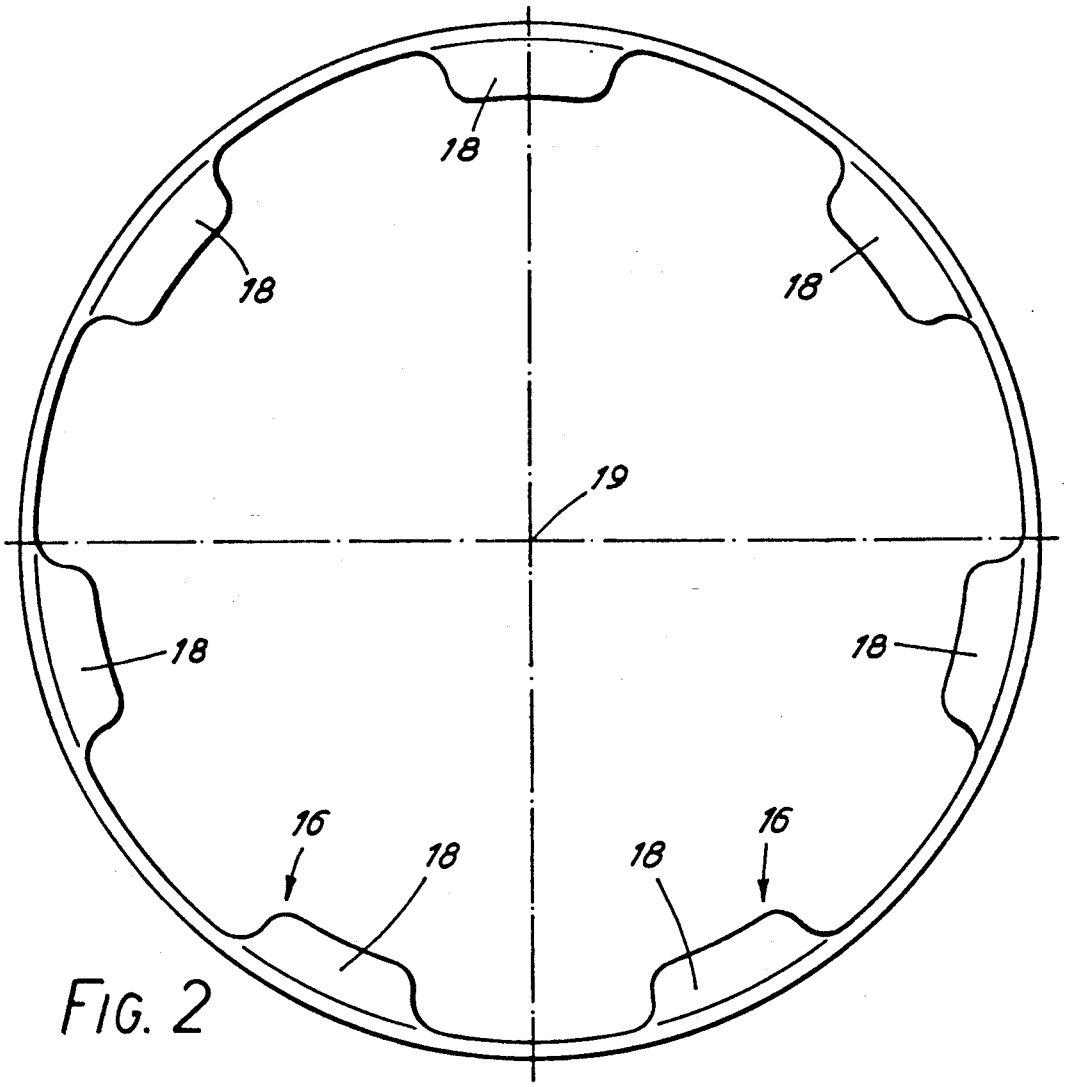
FIG. 2 is an underneath plan in the direction of the arrow 2 of FIG. 1.
Figure 3:
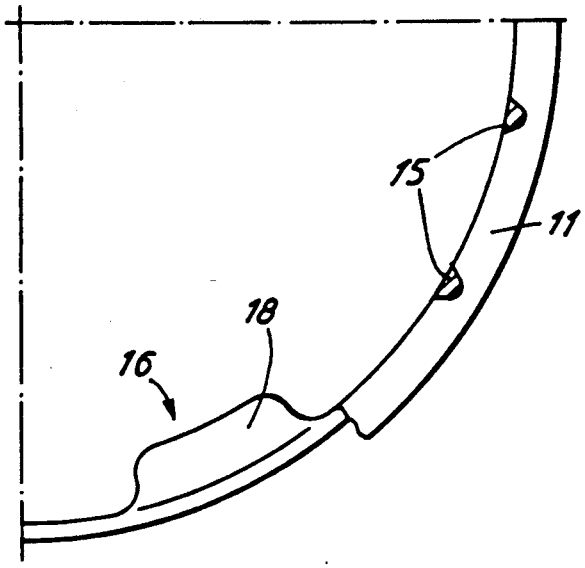
FIG. 3 is a part sectional plan view on the line 3—3 of FIG. 1.

Referring first to FIGS. 1 to 3, the closure shown is molded from a resilient plastics material and comprises a top 10, an annular skirt 11 depending from the top and formed with a screw-thread 12 on its inner surface, and a tamper-evident ring 13 spaced from the bottom edge of the skirt by an axial gap 14 across which extend frangible bridges 15 molded integrally with the skirt 11 and ring 13.

The inner surface of the ring 13 has formed on it an odd number of circumferentially-spaced protrusions 16, each having an abutment end surface 17 nearer the top inclined at a small angle of up to 15° away from the top in a radially inward direction and having a cam surface 18 conically inclined outward away from the central axis 19 of the closure. The protrusions, which are shown in their unstressed positions in chain lines in FIG. 1, are axially spaced from the gap 14. An arcuate-section groove 22 is formed in the outer surface of the ring at a location axially between the gap 14 and the end surfaces 17 of the protrusions. Above the upper edge of the groove 22, in the regions circumferentially between the bridges 15, the outer surface of the ring is inclined inward at an angle $\theta$ as shown at 23 in FIG. 1, reducing the thickness of the ring 13 in the region adjoining the gap 14.

The bridges 15 are equi-distantly spaced from each other but the number and locations of the bridges and protrusions are independent of each other.

The end surfaces 17 of some of the protrusions 16 may be differently spaced from the bottom edge of the ring 13 to others of the protrusions.

Figure 4:
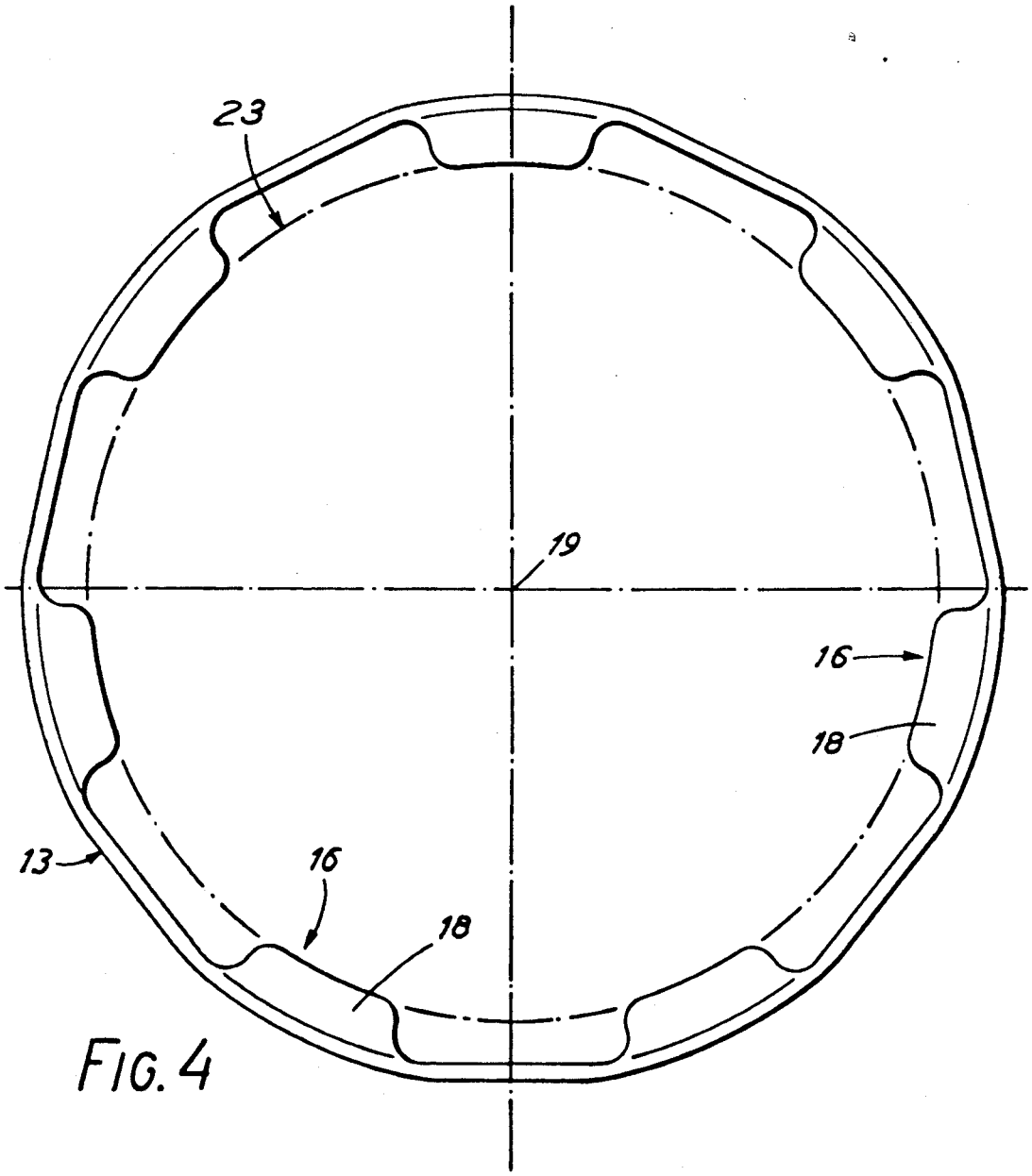
FIG. 4 is an view corresponding to FIG. 2 illustrating how the temper-evident ring becomes deformed during application of the closure.

When the closure is applied to a screw-threaded container having an annular security band formed with a shoulder at its lower end in the well-known manner, the inclined cam surfaces 18 of the protrusions come into engagement with the security band and are splayed outward by the security band causing the ring 13 to stretch and distort locally tending to flatten the curvature of the ring between adjacent protrusions as shown in FIG. 4 an din full lines in FIG. 1, and hinge outward, assisted by the weakening effect of the annular groove 22 on the wall of the ring, until the closure is fully engaged and the protrusions pass beyond the shoulder permitting the ring to contract resiliently. Reference numeral 23 indicates the outside diameter of the neck of the container. Since the protrusions are provided in an odd number, seven in this instance, there is diametrically opposite the middle of each protrusion a gap between two protrusions. This reduces the amount by which the ring is required to expand during application of the closure and also permits the ring to wriggle or shift about diametrically to a small extent as it moves over the shoulder during application.

When the closure is unscrewed the end surfaces 17 of the protrusions 16 come into abutment with the shoulder on the container resisting further upward movement of the ring 13 and causing the bridges to be fractured. The removal of the closure can then be completed. Thus, fracture of the bridges is evidence that the closure has been removed. Where the end faces 17 of the protrusions are at different distances from the bottom edge of the ring 13 as described above, the frangible bridges are subjected to breaking stresses at different times which are related to the times at which the protrusions adjacent a bridge come into abutment with the shoulder on the container during unscrewing of the closure from the container.

The provision of the annular groove 22 in the outer surface of the ring between the gap 14 (or a line of weakening provided for the same purpose) and the protrusions 18 is particularly advantageous in relation to stripping of the moulded closure from the mould during manufacture, the sequence of operations in which is described and illustrated in our U.S. Pat. No. 4,899,898.

Figure 5:
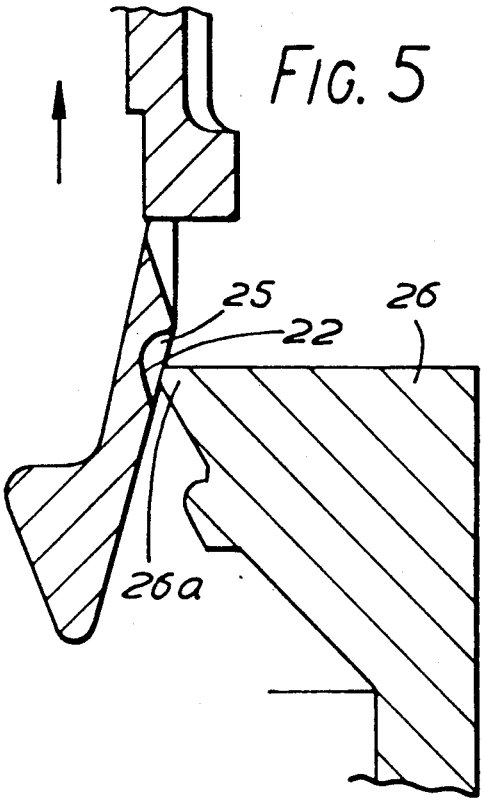
FIGS. 5 to 8 illustrate closures according to the invention and incorporating optional minor modifications.

A plurality of ribs 25 may be provided bridging the groove 22 as shown in FIG. 5 to prevent the radially inner tip 26*a* of the mould part 26 which shapes the bridges from entering the groove 22 during stripping of the closure from the mould.

Figure 6:
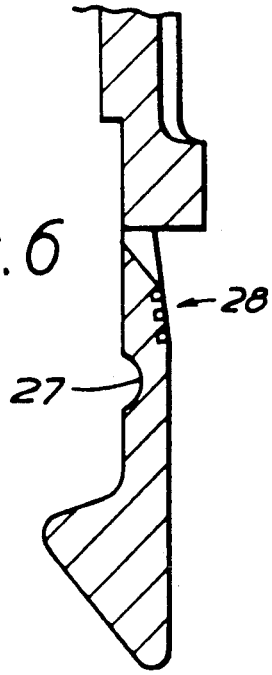
Figure 7:
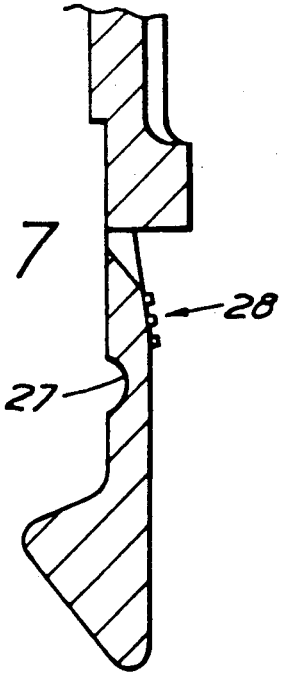

In one construction described and illustrated in our above-mentioned application, groove 22 is replaced by a corresponding groove 27 on the radially inner surface of the ring, and in such a construction the mould part which forms the bridges may be shaped to impress or emboss the radially outer surface of the ring 13 at a location above the level of the internal groove 27 as shown in FIGS. 6 and 7 respectively. The primary purpose of the impressed or embossed markings 28 is to provide interengaging reaction surfaces on the mould part and the ring which protect the bridges during axial stripping of the core from out of the moulded closure during manufacture. A similar function is performed in the internally-grooved arrangement of FIG. 8 by providing, on the mould part 26 which forms the bridges, a reverse taper on the portion 29 of its inner surface just below the brides. In the arrangements of FIGS. 6 and 7 the impressed or embossed matter 28 may comprise pictorial and or descriptive matter and can thus perform a very useful secondary function.

Figure 9:
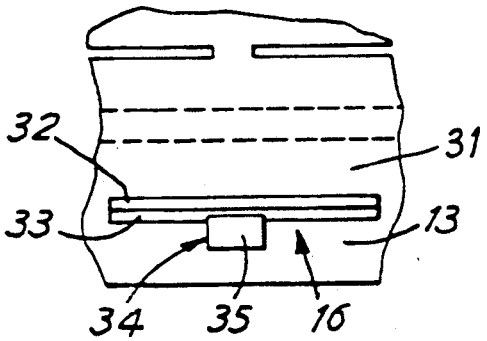
FIGS. 9 and 10 are respectively fragmentary front and side views of an alternative form of protrusion.
Figure 10:
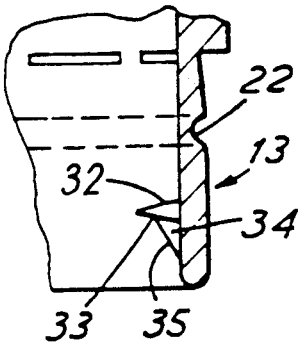

The form of the protrusions 16 shown in FIGS. 1 to 8 is merely one of numerous possible forms. One alternative form of each protrusion is shown in FIGS. 9 and 10 and comprises a peripherally extending rib 31 of generally triangular section so as to present upper and lower faces 32, 33 which are respectively inclined upward and downward, and a wedge shaped part 34 disposed centrally of the rib and presenting an inwardly facing cam surface 35 which is inclined downwardly. On applying the closure the wedge-shaped parts engage the security band on the neck of the container and cause the part of the ring below the groove 22 to hinge outward to enable the protrusions to pass over the security band. When the closure is removed, the upper surfaces of the ribs abut the underside of the band and their resistance to further upward movement as the closure is unscrewed causes the bridges to fracture.

Figure 8:
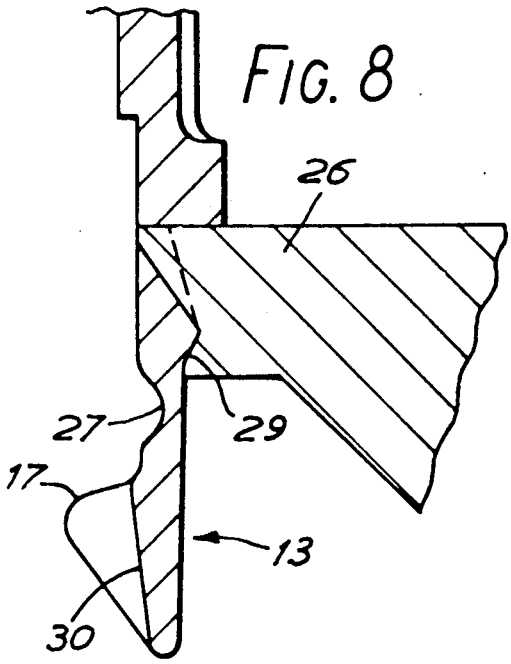

FIG. 8 also shows how the internal diameter 30 of the ring 13 in the spaces between the protrusions below the top surfaces of the protrusions can be regulated so as to determine the thickness of the ring at positions in its axial length and thus at achieve optimum strength in the ring to facilitate stripping of the core from the moulded closure and application of the closure to a container without breaking the ring.

I claim:

1. A container closure of plastic material comprising a top, an annular skirt depending from the top and formed with a screw thread on an internal surface, said skirt having an end remote from the top, a tamper-evident ring having a radially inner surface and a radially outer surface, and an attachment comprising a series of frangible bridges circumferentially spaced around said skirt to provide a weakening line of a band of circumferentially spaced gaps and bridges between said end and ring, said ring having a plurality of circumferentially spaced radially inwardly projecting protrusions each having an end abutment surface generally facing toward said top but having a slight inclination away from the top in a radially inward direction and an inwardly facing cam surface inclined away from the top, the protrusions being so circumferentially spaced that no two of the protrusions are diametrically opposite each other, said ring having an annular groove formed in its radially outer surface at a location axially between the protrusions and the bridges at said weakening line.

2. A closure as claimed in claim 1, wherein the protrusions are uniformly disposed about the ring and are provided in an odd number.

3. A closure as claimed in claim 1, wherein impressed or embossed features are formed on the radially outer surface of the tamper-evident ring at a location axially between the bridges and said groove.

4. A closure as claimed in claim 3, wherein said features comprise pictorial and/or descriptive matter.

5. A closure as claimed in claim 1, wherein a radially outwardly inclined shoulder is formed on the radially outer surface of the tamper-evident ring at a location axially between the bridges and said groove.

* * * * *

UNITED STATES PATENT AND TRADEMARK OFFICE

CERTIFICATE OF CORRECTION

PATENT NO. : 5,131,550

DATED : July 21, 1992

INVENTOR(S) : Nigel Thompson

Figure 11:
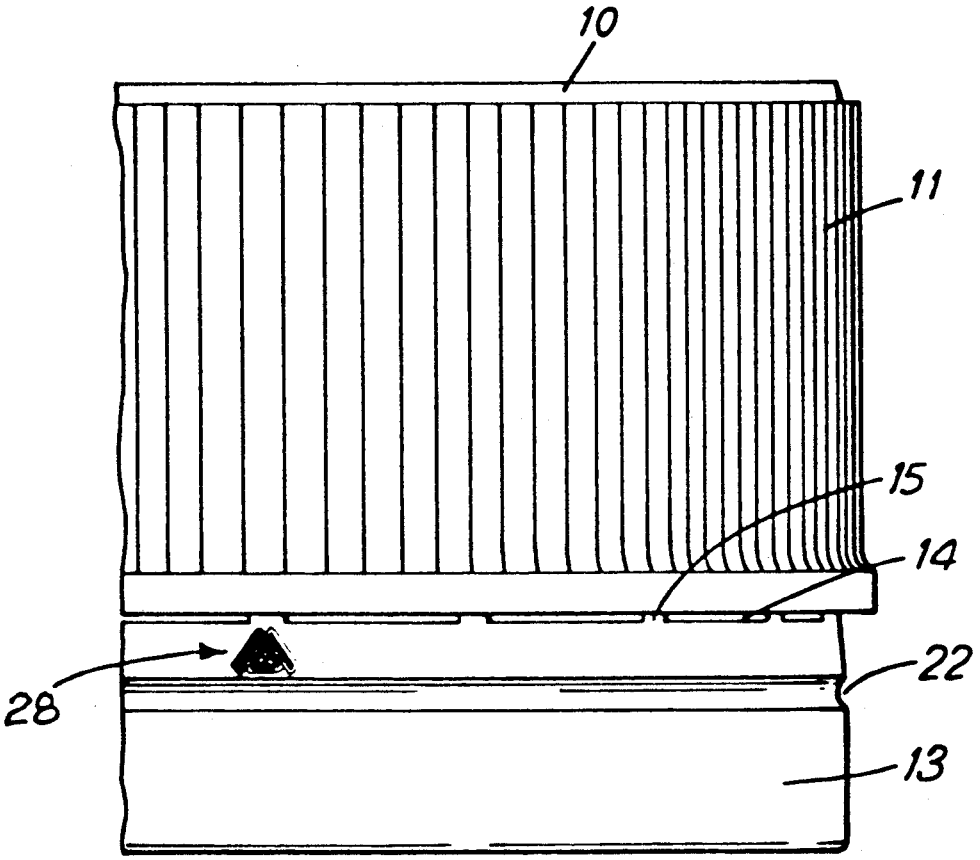
FIG. 11 is a partial outside view of the cap of FIG. 1.

It is certified that error appears in the above—identified patent and that said Letters Patent is hereby corrected as shown below:

Column 1, line 40, for "part sectional plan view on the line" substitute --fragmentary underneath plan partly in section on the plane--;

line 47, delete "and";

line 49, change the period (.) to a comma (,) and insert --and--;

delete line 50 and insert --FIG. 11 is a fragmentary elevation corresponding to FIG. 1--.

Column 2, line 22, "an din" should read --and in--.

Column 3, line 13, "and or" should read --and/or--; and after "matter" insert --as illustrated in FIG. 11,--.

Signed and Sealed this

Twelfth Day of October, 1993

*Attest:*

*Attesting Officer*

Bruce Lehman

BRUCE LEHMAN

*Commissioner of Patents and Trademarks*